United States Patent [19]

Happel et al.

[11] 3,958,757

[45] May 25, 1976

[54] INJECTION VALVE

[75] Inventors: Robert Happel, Waiblingen-Bittenfeld; Lothar Maier, Fellbach,, Germany

[73] Assignee: Daimler-Benz Aktiengesellschaft, Germany

[22] Filed: Apr. 9, 1975

[21] Appl. No.: 566,189

[30] Foreign Application Priority Data

Apr. 13, 1974 Germany ..... 2418227
Dec. 19, 1974 Germany ..... 2460111

[52] U.S. Cl. ..... 239/125; 239/132.3; 239/535; 239/584

[51] Int. Cl.[2] ..... B05B 1/32; B05B 1/34; B05B 9/00

[58] Field of Search ..... 239/533, 534, 535, 88, 239/90, 91, 124, 132.3, 125, 584, 585

[56] References Cited

UNITED STATES PATENTS

| | | | |
|---|---|---|---|
| 1,589,245 | 6/1926 | Scott | 239/535 |
| 2,052,560 | 9/1936 | French | 239/535 |
| 3,212,715 | 10/1965 | Cocks | 239/125 |
| 3,241,768 | 3/1966 | Croft | 239/585 X |
| 3,669,354 | 6/1972 | Helyer | 239/533 X |

FOREIGN PATENTS OR APPLICATIONS

| | | | |
|---|---|---|---|
| 440,673 | 2/1927 | Germany | 239/584 |
| 489,509 | 1/1930 | Germany | 239/533 |
| 587,420 | 4/1947 | United Kingdom | 239/124 |

*Primary Examiner*—Robert S. Ward, Jr.
*Attorney, Agent, or Firm*—Craig & Antonelli

[57] ABSTRACT

An injection valve for the injection of fuel during a low pressure phase into a space subjected to pressure fluctuations, which includes an injection nozzle equipped with a nozzle seat that is provided with at least one nozzle aperture; the nozzle aperture is adapted to be covered off by a nozzle needle which is adapted to be lifted and is limited in its lifting movement by an abutment at least in its opening direction; the nozzle seat is thereby movable in the lifting direction of the nozzle needle.

53 Claims, 6 Drawing Figures

INJECTION VALVE

The present invention relates to an injection valve for the injection of a liquid into a space subjected to pressure fluctuations during a low pressure phase, especially for the injection of fuel into a combustion space of an internal combustion engine, which includes an injection nozzle with a nozzle seat, that is provided with at least one nozzle aperture or opening, which is adapted to be covered off by a nozzle needle or pin adapted to be lifted off and limited in its lifting or stroke movement at least in the opening direction by an abutment.

Known injection valves of this type, insofar as they are arranged directly terminating in a combustion space or a combustion chamber of an internal combustion engine of the injection of fuel, such as Diesel oil or gasoline, customarily operate by means of a hydraulic control for the nozzle needle closing off in its rest position the nozzle opening provided in the nozzle seat, where the injection periods are determined by way of the hydraulic control, and therewith customarily by way of the injection pump. This is so as the nozzle needle is stressed in the direction toward its rest position with a spring pressure larger than the maximum gas pressure acting on the same which is built up in the combustion space or the combustion chamber, and it is lifted off against this spring pressure by the injection liquid whose pressure corresponds to the pressure built up in the respective pump cylinder. The liquid pressure thereby acts on a cone surface of the nozzle needle or pin. Extreme pressures in the combustion space or in the combustion chamber make necessary with such a solution extremely large spring pressures which conversely require again particularly high injection pressures for the lifting off of the nozzle needle, at which the exact metering of smallest liquid quantities naturally involves particular difficulties.

An injection valve is now to be provided by the present invention, in which the aforementioned dependencies between maximum combustion space pressure, spring pressure for the nozzle needle and injection pressure do not exist and in which accordingly the determination of the mentioned values can take place independently of one another. Furthermore, a valve is to be provided by the present invention which enables the metering in the discharge plane necessary for the injection of smallest quantity, i.e., independently of the pump, with extremely short injection periods, and which as a low pressure injection valve simultaneously assures also a rebound safety with absolute tightness at extremely high combustion pressures and tempertures and which is also insensitive to temperatures.

According to the present invention, this is achieved with an injection valve of the aforementioned type in that the nozzle seat is movable in the stroke or lift direction of the nozzle needle. This movability of the nozzle seat has as a consequence an adaptation of the sealing pressure between the nozzle seat and the nozzle needle to the pressure prevailing in the space, into which the liquid is injected, and therewith for example to the pressure prevailing in a combustion space or in a combustion chamber of an internal combustion engine so that at high pressures in the injection space also correspondingly high sealing pressures result which prevent a rebounding. Furthermore the pressure adaptation takes place also independently of the respective temperature so that an absolute temperature insensitivity exists. Since at low pressures in the injection space, thus, for example, again in the combustion space or in a combustion chamber of an internal combustion engine, also correspondingly low sealing pressures exist, the nozzle needle has to be pressed against the nozzle seat only with comparatively slight prestress force, and correspondingly the stroke or lifting devices for the nozzle needle can be constructed comparatively weakly. The attainment of extremely short injection periods as well as also the metering of smallest injection quantities up to the order of magnitude of less than 1 mm.$^3$ per cycle is facilitated thereby.

In one embodiment of the present invention, it is appropriate if the stroke movement of the nozzle needle is adapted to be initiated independently of the injection pressure because a simple construction of the parts of the injection installation arranged ahead of the injection valve thus becomes possible and the injection pressure can also be kept low.

It is furthermore appropriate for limiting the stroke or lift movement of the nozzle needle if an abutment is provided for the nozzle needle also in the closing direction. This is appropriate in particular also when the nozzle needle is spring-loaded in the direction toward its closing position. Constructively, the stroke movement of the nozzle needle can be limited in a simple manner by abutments in that at least one shoulder engaging in a recess of the valve body is coordinated to the nozzle needle, whose end faces form the abutment surfaces, whereby this shoulder can be formed preferably by an annular collar. The recess around the shoulder or collar is provided appropriately in the end face of the valve body opposite the nozzle seat, whereby a covering member is provided at this recess whose end face faces the recess and forms an abutment surface. With such a construction, the covering member may be formed with advantage by a disk which has a radial gap so that it is adapted to be placed laterally over the nozzle needle.

It is furthermore advantageous within the scope of the present invention, if the covering member and the valve body are arranged at least partially within an external housing and are retained by the same.

The movability of the nozzle seat aimed at according to the present invention in the stroke movement of the nozzle needle, can be attained in a simple manner with the stroke paths which are contemplated, in that the nozzle seat is formed by a membrane or diaphragm. This diaghragm can be constructed in one piece with the valve body or may also be formed by a part which is clamped to the valve body or connected therewith. Appropriately, the diaphragm is thereby constructed disk-shaped. The movability of the nozzle seat required in the stroke direction of the nozzle needle therebeyond can be attained also by a part displaceably guided in the stroke direction of the nozzle needle. For example, a piston or the like may be used as such a part.

In order to prevent an excessive heating of the part forming the nozzle seat as also of the nozzle needle, according to a further feature of the present invention, a cooling for the nozzle seat and for the nozzle needle may be provided, whereby this cooling takes place preferably by the injection medium. With slight injection quantities, provision is thereby made to provide a circulation for the liquid to be injected, of which a portion is released respectively for the injection. Such a cooling can be achieved in a simple manner in that the nozzle needle in its area adjacent the nozzle seat and/or the nozzle seat are arranged at least partly freely exposed and are contacted by the liquid to be injected. Additionally, a shielding against heat flowing in from the outside, can be achieved in that the return of the liquid takes place by way of an annular return flow gap surrounding the nozzle needle.

The circumcirculation of the nozzle needle within the seat area can be further utilized within the scope of the present invention to improve the atomization of the fuel, which frequently offers difficulties particularly with valves injecting with low pressure and which is very essential for the aimed-at good mixture formation.

According to the present invention, the fine atomization of the injection jet necessary, for the best possible combustion can be achieved in every case with an injection valve of the aforementioned type also with low pressure injection in that the free space about the nozzle needle within the area of the nozzle seat is constructed as an annular space and forms a swirling chamber. The liquid is set into rotation about the nozzle axis within this swirling chamber which forms a type of intermediate reservoir, which has as a consequence that during the discharge the nozzle jet expands conically shaped very rapidly, starting from the nozzle aperture, whence the desired fine atomization of the liquid or of the fuel is achieved.

In one embodiment of the present invention, the rotation of the liquid present in the swirl chamber can be attained in that the swirl chamber is provided with at least one inflow aperture terminating approximately tangentially. The rotary effect can be still further enhanced especially with a larger volume of the swirl chamber in that the swirl chamber is provided also with at least one return flow aperture which preferably adjoins the swirl chamber approximately tangentially.

Appropriately, the inflow aperture and the return flow aperture are mutually offset in the axial direction of the nozzle axis so that a rotating liquid column forms in the swirl chamber. The inflow aperture is thereby preferably provided adjacent to the nozzle seat.

A construction has proved as appropriate for the swirl chamber within the scope of the present invention, in which the swirl chamber surrounds or encloses the nozzle needle at least within the area of its tip and forms an annular space for the liquid. The outer annular space wall can thereby be formed by a bush-like insert member which is spring-loaded in the direction toward the nozzle seat and is supported with respect thereto.

Furthermore, the outer annular space wall may also be formed by the cylindrical nozzle needle guidance whereby the nozzle needle appropriately includes a radially reinforced guide collar disposed at a distance to the nozzle needle tip, wich simultaneously forms the upper boundary of the annular space.

Accordingly, it is an object of the present invention to provide an injection valve which avoids by simple means the aforementioned shortcomings and drawbacks encountered in the prior art.

Another object of the present invention resides in an injection valve which obviates the need for extremely large spring forces notwithstanding extremely large pressures in the combustion space or in the combustion chamber on an internal combustion engine, yet enables a fine and accurate metering of the liquid quantity to be injected.

A further object of the present invention resides in an injection valve which permits the exact metering of even smaller liquid quantities without any difficulties.

Still a further object of the present invention resides in an injection valve in which the interrelationships between maximum combustion space pressure, spring pressure for the nozzle needle and injection pressure are eliminated, thereby enabling a determination of the respective values independently of one another.

Still another object of the present invention resides in an injection valve which enables the accurate metering necessary for smallest injection quantities, independently of the pump and with extremely short injection periods.

Another object of the present invention resides in an injection valve which insures absolute tightness, even at extremely high combustion pressures and temperatures, and which at the same time is relatively insensitive to temperatures.

A further object of the present invention resides in an injection valve of the type described above in which the lifting devices can be constructed in a relatively simple manner enabling the initiation of the lifting movement of the nozzle needle independently of the injection pressure.

A still further object of the present invention resides in an injection valve in which the injection pressure can be kept relatively low and therewith a simple construction can be achieved for the parts of the injection system arranged upstream of the injection valve itself.

Another object of the present invention resides in an injection valve which is not only simple in construction and capable of achieving the aforementioned objects, but which is also effectively protected against overheating of any parts thereof by extremely simple means.

Still a further object of the present invention resides in an injection valve which ensures a fine atomization of the injected jet under all operating circumstances, thereby insuring best possible combustion conditions.

These and further objects, features and advantages of the present invention will become more apparent from the following description when taken in connection with the accompanying drawing which shows, for purposes of illustration only, several embodiments in accordance with the present invention, and wherein.

Figure 5:
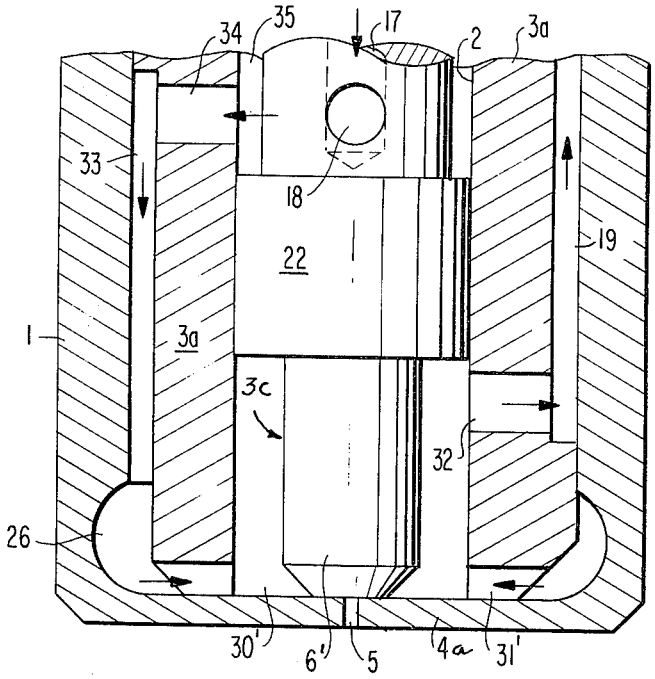
Figure 6:
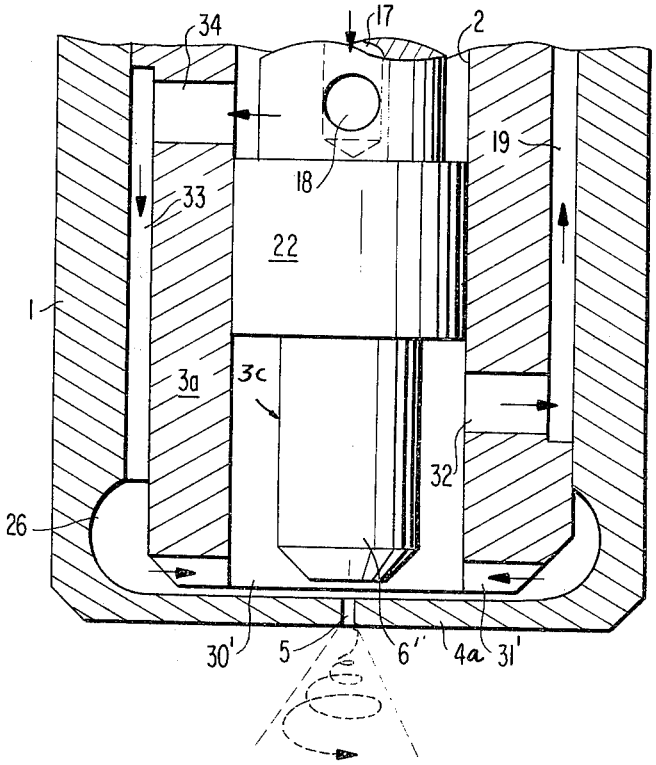

FIG. 5 is a schematic partial longitudinal cross-sectional view through a still further embodiment of an injection valve in accordance with the present invention illustrating the same in the closed position, whereby the radially outer boundary wall of the swirl chamber is formed by a cylindrical nozzle needle guidance, at which is supported the nozzle needle by way of a guide collar; and FIG. 6 is a schematic partial longitudinal cross-sectional view through the injection valve according to FIG. 5 in the open position.

Figure 1:
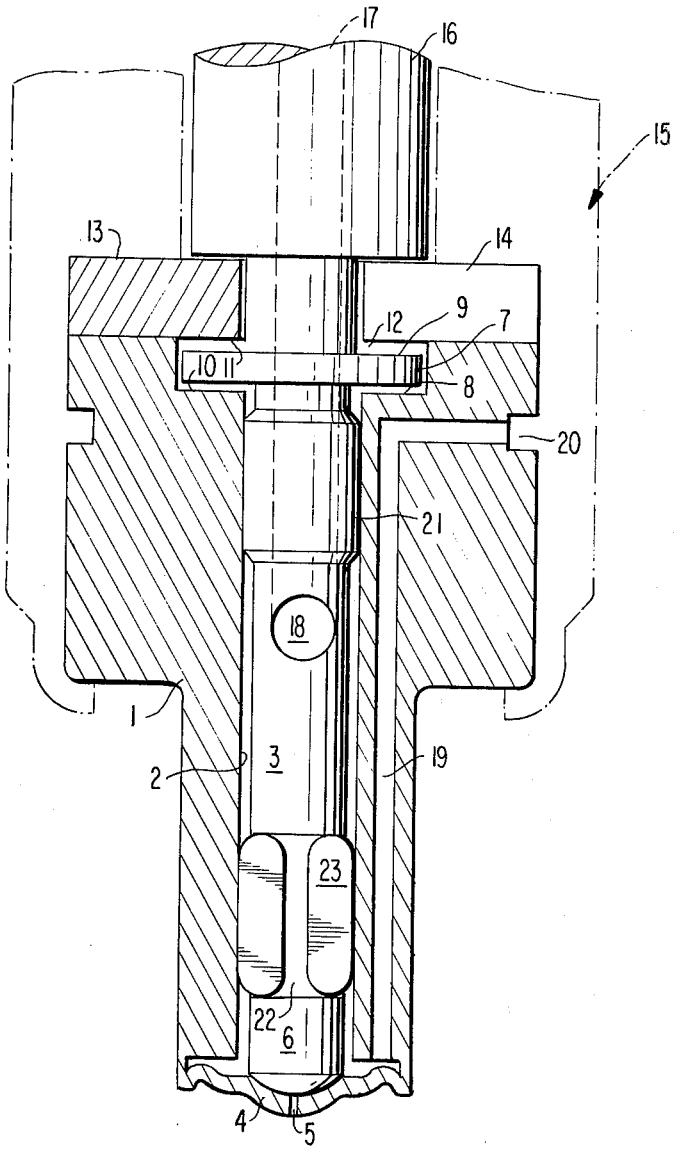
FIG. 1 is a schematic longitudinal cross-sectional view through one embodiment of an injection valve according to the present invention.

Referring not to the drawing wherein like reference numerals are used throughout the various views to designate like parts, the injection valve illustrated in FIG. 1 for an internal combustion engine includes a valve body 1 which is provided with a longitudinal bore 2, in which a nozzle needle or pin 3 is longitudinally displaceably arranged. A nozzle seat 4 is mounted on the valve body 1 as lower closure member, in which a nozzle opening or aperture 5 is centrally provided in the illustrated embodiment.

The nozzle seat 4 which according to the present invention is movable in the lift or stroke direction of the nozzle needle 3, at least within its central area in communication with the nozzle needle 3, is constituted in the illustrated embodiment by a diaphragm which is connected with the valve body 1. The diaphragm may thereby possess different wall strengths over its diameter, i.e., different thicknesses, whereby an improved movability and especially a limitation of the movability to a less endangered zone can be achieved. The nozzle needle 3 is spring-loaded in a conventional manner, not illustrated in detail in the illustrated embodiment, in the direction toward the nozzle seat 4 by way of a spring coordinated thereto. The nozzle needle 3 additionally extends, starting from its end area 6 adjacent the nozzle seat 4, through the longitudinal bore 2 of the valve body 1, whereby the magnitude of the lift or stroke movement of the nozzle needle 3 is limited by abutments which, on the one hand, are formed by a shoulder 7 having abutment surfaces 8 and 9 which is constructed as annular collar and is arranged on the nozzle needle 3. Counter-surfaces 10 and 11 are adjacent to the abutment surfaces 8 and 9, of which the counter surface 10 is formed by the end face of a recess 12 provided at the end face in the valve body 1 concentrically to the longitudinal bore 2, to which is mounted the covering member 13. The covering means 13 is constructed disk-shaped and includes a radial gap 14 so that it can be installed by sliding it over the nozzle needle 3 from the side thereof. The end face of the covering member 13 facing the recess 12 forms a further counter-surface 11 for the shoulder 7 so that the stroke path of the nozzle needle 3 corresponds to the play of the shoulder 7 within the recess 12. The necessary prestress of the covering member 13 with respect to the valve body 1 is achieved by an external housing generally designated by reference numeral 15 and only schematically indicated herein in dash and dot lines, which at least partly overlaps the covering member 13 and the valve body 1. In its area disposed above the covering member 13 and the valve body 1, the external housing 15 accommodates the magnet core 16 of a conventional coil, also arranged on the inside of the external housing 15 and not illustrated in detail herein, by means of which the nozzle needle 3 is adapted to be lifted off from the nozzle seat 4 at least when the nozzle seat 4 assumes at least in approximation its outer end position.

The nozzle needle 3 is provided in the illustrated embodiment preferably at least in its upper area with a concentric bore 17, by way of which the liquid to be injected is supplied and which terminates at least by way of one cross bore 18 above the nozzle seat 4 in the longitudinal bore 2 which receives the nozzle needle 3 with play at least in its area disposed underneath the cross bore 18 adjacent its nozzle seat 4. Liquid supplied by way of the bore 17, especially therefore Diesel oil or gasoline, flows by way of the cross bores 18 into the longitudinal bore 2 where it reaches the area of the nozzle seat 4 and is either discharged and sprayed out by way of the nozzle aperture 5 with a lifted off nozzle needle 3 or again flows out of the injection valve by way of a return flow channel 19. The return flow channel 19 extends in the illustrated embodiment on the inside of the valve body 1 at first parallel to the longitudinal bore 2, and terminates within an area covered by the external housing 15 in an annular channel 20, which is formed by a circumferential groove in the ring or annular body 1. The liquid flows back from the annular channel 20 in a manner not illustrated in detail to the liquid reservoir tank, for example, to the fuel tank Inside the longitudinal bore 2 of the body 1, the nozzle needle 3 is provided near the shoulder 7, and preferably between the shoulder 7 and the cross bore 18, with a guide section 21 matched to the diameter of the longitudinal bore 2, which preferably has a cross section corresponding to the longitudinal bore 2, i.e. a cylindrical cross section. Near the end area 6 of the nozzle needle 3, a further guide section 22 is provided which includes several chamfered or bevelled off sections 23 over its circumference, through which the liquid, i.e., in particular fuel, passing through the cross bore 18 into the longitudinal bore 2, flows toward the nozzle aperture 5.

The movability of the nozzle seat 4 existing according to the present invention in the stroke direction of the nozzle needle 3 whose stroke paths are limited by the cooperating abutment surfaces 8, 10, and 9, 11, is assured in the embodiment according to FIG. 1 by a construction of the nozzle seat as diaphragm, whereby the diaphragm in the illustrated case is constructed in one piece with the valve body 1. Of course, the diaphragm which forms the nozzle seat, may also be fixed with respect to the valve body 1 by welding, clamping or in any other known manner. Within the area of the nozzle opening 5, the diaphragm forming the nozzle seat 4 is curved corresponding to the ball-shaped configuration of the part of the nozzle needle 3 covering the nozzle aperture 5 so that upon abutment of the nozzle needle 3 at the nozzle seat 4, an areal seal of the nozzle aperture 5 results as a result of areas in sealing contact with each other, which simultaneously prevents that a pressure corresponding to the liquid pressure builds up between the nozzle needle 3 and the nozzle seat 4 within the area disposed about the nozzle aperture 5.

Figure 2:
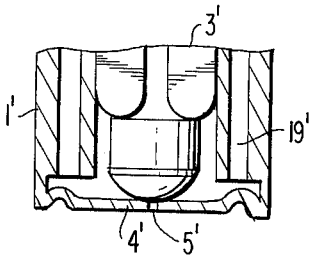
FIG. 2 is a partial achematic longitudinal cross-sectional view of a second embodiment of an injection valve according to the present invention through the area of the injection valve at the nozzle seat, whereby the return channel is constructed as annular gap.

In the embodiment according to FIG. 2, the diaphragm forming the nozzle seat 4′ and containing the nozzle aperture 5′, which again is constructed in one piece with the valve body 1′, is constructed at least approximately flat so that with the ball-shaped end of the nozzle needle 3′ an essentially point-like abutment results between the nozzle needle 3′ and the nozzle seat 4′, by means of which exclusively the nozzle aperture 5′ is covered off. Especially with low pressures such a construction of the diaphragm forming the nozzle seat 4′ also leads to a complete sealing of the nozzle opening 5′. Also in this case thicknesses differing over the diameter of the diaphragm are possible in accordance with the present invention.

Since the diaphragm forming the nozzle seat 4 or 4' extends nearly over the full cross section of the valve body 1, a cooling of the nozzle seat 4 and therewith also of the nozzle needle 3 in its corresponding end area can be achieved by way of the through-flowing liquid also with relatively low flow velocities. For improving the cooling effect, an annular gap 19', as indicated, may be provided as return flow channel so that also a shielding exists against inflowing heat. A warping of the inner part is prevented thereby.

In lieu of a diaphragm, the nozzle seat may also be formed by a piston or the like insofar as a yieldingness or displaceability in the stroke direction of the nozzle needle is also assured by the construction or guidance of this part.

The injection valve according to the present invention which is suitable in particular for the injection of auxiliary fuel into an ignition or combustion chamber of an internal combustion engine and which enables also the metered addition of smallest fuel quantities, is exposed by its arrangement (now shown) inside the internal combustion engine of the pressure fluctuations inside the ignition or combustion chamber. If one now starts with the fact that during the suction stroke of the engine at least in the end phase of the suction, a vacuum prevails in the ignition or combustion chamber into which the injection valve according to the present invention is inserted, then the nozzle sear 4 is not loaded or stressed in the direction toward the nozzle needle 3. By lifting the nozzle needle 3 through activation of the magnet coil, to which belongs the magnet core 16, or also by a hydraulic pulse, in case a servo-piston is provided in lieu of the magnet core 16, the nozzle needle 3 is not lifted off from the nozzle seat 4 and as a result thereof, the nozzle aperture 5 is opened up. A small quantity of the fuel existing with excess pressure can now penetrate into the ignition or combustion chamber by way of the nozzle aperture 5. The liquid pressures necessary therefor are comparatively small and lie, for example, at the order of magnitude of about 2 Bars.

During the injection operation, during which the nozzle seat 4 assumes its lower dead-center position by reason of the vacuum prevailing in the combustion chamber, on the one hand, and by reason of the actuation of the liquid subjected to pressure, on the other, the contact between the nozzle needle 3 and the nozzle seat 4 is interrupted. After the termination of the injection operation, the nozzle needle 3, which for the injection was lifted off independently of the liquid pressure, especially hydraulically or magnetically, is again released and is now displaced by the spring (not shown) in the direction toward the nozzle seat 4, The injected fuel quantity may thereby be varied by the length of the injection operation since the cross section of the nozzle aperture 5 remains constant during the injection operation.

The end of the suction phase approximately coincides timewise with the closing of the nozzle aperture 5 by the nozzle needle 3 subjected to a spring load, and the compression pressure now starts to build up in the combustion or ignition chamber. The latter leads to a loading of the nozzle seat 4 against the nozzle needle 3 which initially effects only an additional abutment of the nozzle seat 4 against the nozzle needle 3. If the load on the nozzle seat 4 conditioned by the compression pressure exceeds the oppositely directed load by the liquid pressure and by the abutment of the nozzle needle subjected to a spring pressure, then the nozzle needle 3, is displaced by way of the diaphragm 4 into its upper end position, in which the abutment surface 9 and 11 come into mutual abutment. A lifting off of the nozzle needle 3 from the nozzle aperture 5 by reason of particularly high pressures in the ignition or combustion chamber is therewith precluded. In the solution according to the present invention the spring force therefore has to be selected only so large that, taking into consideration any possible counter forces conditioned by the liquid pressure and the comparatively small gas forces which become effective by way of the nozzle aperture 5, the nozzle needle 3 is not lifted off from the nozzle seat 4 but covers off the nozzle aperture 5 as point-like as possible. If the gas forces acting on the nozzle seat now exceed the oppositely directed forces conditioned by the liquid pressure and the abutment pressure of the spring, then the nozzle seat 4 together with the nozzle needle 3 is displaced in the direction of action of the forces conditioned by the gas pressure, until the abutment surfaces 9 and 11 come into abutment. As soon as this is the case, the ratio of the forces conditioned by the spring pressure to the oppositely acting gas forces effective by way of the nozzle aperture 5, are no longer determinative for the seal between the nozzle needle and the nozzle seat.

Accordingly, the spring which loads the nozzle needle can be constructed relatively weak since at low pressure injection, the liquid pressure is relatively slight and since gas pressure forces acting on the nozzle seat will result correspondingly already at relatively low compression, which exceed the liquid pressure forces and which effect a displacement of the nozzle seat and of the nozzle needle in the direction of the gas pressure forces.

FIGS. 3 to 6 illustrate two embodiments of a valve according to the present invention by means of which a wide spreading-out or fanning-out of the nozzle jet is to be achieved during the injection in order to arrive at a good mixture formation. Since the valves referred to in these figures correspond in principle to the construction of the valve illustrated in FIG. 1, corresponding reference numerals are used. Furthermore, for the same reason, a detailed, overall description and overall illustration of the valve is dispensed with for these figures and insofar as necessary, reference is made to the detailed description and illustration of FIGS. 1 and 2.

Figure 3:
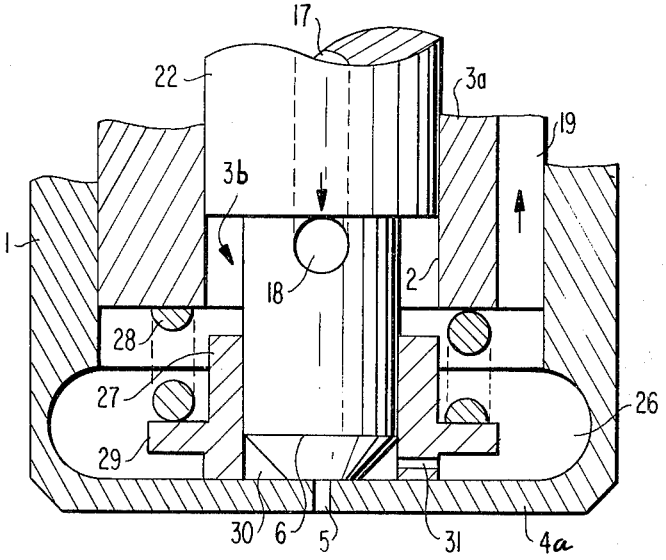
FIG. 3 is a schematic longitudinal cross-sectional view through a third embodiment of an injection valve in accordance with the present invention, illustrating the same in the closing position, in which the swirl chamber is delimited radially outwardly by a bush-like insert member.
Figure 4:
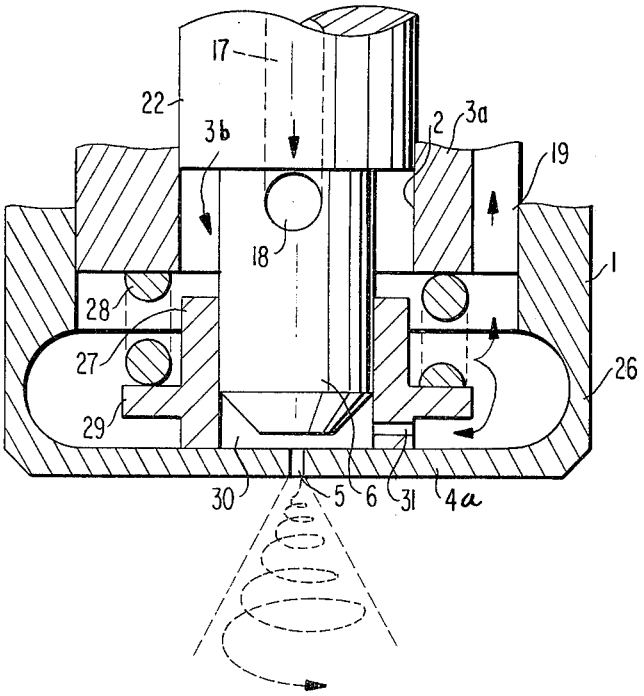
FIG. 4 is a schematic longitudinal cross-sectional view of the injection valve of FIG. 3, illustrating the same in the open position.

In the embodiment according to FIGS. 3 and 4, a bush-shaped nozzle needle quidance **3*a* is provided in the valve body 1, which in its turn is provided with a longitudinal bore 2 for the nozzle needle 3*b*. The latter thereby possesses at least in its end area 6' coordinated to the nozzle aperture 5, a diameter which is smaller than that of the longitudinal bore 2, with respect to which it is guided at least by way of a collar-like guide section 22. A central bore 17 provided in the nozzle needle 3*b* termintes in a cross bore 18 underneath this guide collar 22 which corresponds in its diameter to the diameter of the longitudinal bore 2, so that liquid supplied through the bore 17, especially fuel, is able to flow out by way of the bore 18 into the longitudinal bore 2 which is enlarged in the direction toward the nozzle seat 4*a* into a space 26 which essentially results in that the nozzle needle guidance 3*a* terminates at a distance above the nozzle seat 4*a*. The return flow channel 19 starts from this space 26, which in the illustrated embodiment is formed by an outside groove provided in the nozzle guidance 3*a*.**

Inside the space 26, the nozzle needle end area 6' is surrounded in its area adjoining the nozzle seat 4a by a bush-like insert member 27 which abuts against the nozzle seat 4a and is spring loaded in the direction toward the same by way of a spring 28 which is constructed in this embodiment as coil spring and is supported, on the one hand, on an outside flange 29 coordinated to the bush-like insertion member 27 and, on the other, against the end face of the nozzle needle guidance 3a.

The nozzle needle 3b is constructed tapered in its end area 6' adjoining the nozzle seat 4a so that an annular space 30 results between the insert member 27 and the nozzle needle, which forms a swirl space for the liquid to be discharged by way of the nozzle aperture 5 when lifting the nozzle needle 3b off the nozzle seat 4a. The swirl or vortex is achieved in that at least one inflow opening 31 is coordinated to the annular space 30 which terminates tangentially and by way of which the liquid enters out of the space 26 into the space 30 in such a manner that a rotating flow results.

This rotating flow has as a consequence for the opened injection valve, that, is indicated in FIG. 4, during the injection of the liquid, no compact liquid jet results, but rather a rapidly enlarging spray cone which leads to a very good mixing also at low pressures with the air, into which the injection takes place, within the scope of the operation, especially in the cylinder space of an internal combustion far reaching In other words, a for-reaching atomization of the liquid takes place therefore, i.e., of the fuel, as is a prerequisite for a good combustion.

Whereas in the embodiment according to FIGS. 3 and 4, a discharge of the liquid supplied to the annular space 30 is possible only by way of the nozzle aperture 5, an embodiment is illustrated in FIGS. 5 and 6 in which a discharge of the liquid is possible also into the return flow channel 19 which in conjunction with an enlarged annular space 30' serving as swirl chamber may lead to an enhanced rotation of the liquid within the same, whereby the breaking up and aeration of the nozzle jet discharged by way of the nozzle aperture 5 can be still further improved, In the concrete construction according to FIGS. 5 and 6, the annular space 30' is formed in that the nozzle needle guidance 3a is extended downwardly up to near the nozzle seat 4a and more particularly preferably with the constant diameter of the longitudinal bore 2 so that an annular space results between the guide collar 22 and the nozzle seat 4a, whose radial thickness is determined by the extent of the offset of the end area 6' of the nozzle needle 3c with respect to the guide collar 22.

The inflow apertures 31' terminate tangentially in this annular space 30' adjacent the nozzle seat 4 which are being formed in this embodiment by grooves arranged in the end face of the nozzle needle guidance 3a adjacent to the nozzle seat 4a. At least one preferably tangentially outwardly extending return flow aperture 32 starts from the annular space 30' near the upper end thereof; the return flow aperture 32 is being formed by a bore disposed in a plane approximately perpendicular to the nozzle axis and terminates in the return flow channel 19. The arrangement of the inflow aperture 31' and of the return flow aperture 32 is thereby made in such a manner that as intensive an annular flow as possible is being built up which requires that the inflow aperture 31' and the return flow apertures 32 are oppositely directed in relation to the flow direction.

In this construction according to the present invention the liquid is fed to the inflow aperture or apertures 31' out of a space 26 which surrounds the nozzle needle guidance 3a annular shaped within the area of the nozzle seat 4a and in which terminates an axial feed bore 33 which is in communication with the longitudinal bore 2, by way of a cross bore 34, and more particularly above the guide collar 22 within an area, in which the nozzle needle 3c is again reduced or offset in diameter with respect to the longitudinal bore 2. The feed bore 17 terminates in this annular space 35 resulting therefrom by way of a cross bore 18; the entire liquid is thereby supplied in the described embodiment by way of the supply bore 17, from which the portion flowing back contributes a significant proportion to the cooling of the nozzle seat 4a.

The c, that within the scope of the present invention the nozzle seat 4a is constructed diaphragm-like and has to be movable under pressure load in the direction toward the nozzle needle 3c, can be taken into consideration in the embodiment according to FIGS. 5 and 6 in that the nozzle needle guidance 3a terminates at a distance from the nozzle seat 4a which corresponds to the movement play necessary in the axial direction of the nozzle (FIG. 6). It is, however, also possible to provide a fixed abutment of the nozzle needle guidance at the nozzle seat 4a if the same is so constructed that the area disposed on the inside of the longitudinal bore 2 enables a sufficient movement play. A further possibility with a direct abutment of the nozzle needle guidance at the nozzle seat 4a resides in elastically supporting the nozzle needle guidance in the direction toward the nozzle seat, which requires that a connection of the nozzle needle 3c is established to the valve body 1 which bridges the nozzle needle guidance 3a and may serve as abutment. Finally, it is also possible with a support of the nozzle needle guidance 3a which is elastic in the axial direction, to so limit the movement play thereof that the same may serve simultaneously as abutment for the nozzle needle 3c.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. An injection valve for injecting a liquid into a space subjected to pressure fluctuations during a low pressure phase, said valve comprising a valve body;

an injection nozzle means disposed in said valve body for injecting liquid, said injection nozzle means including nozzle seat means for enclosing said valve body, at least one nozzle aperture means provided in said nozzle seat means for passing said liquid, nozzle needle means for closing said at least one nozzle aperture means, means for moving said nozzle needle means to open said nozzle aperture means, and abutment means for limiting stroke movement of said nozzle needle means in at least a direction of opening of said nozzle aperture means; and means for enabling movement of said nozzle seat means in a direction of said stroke movement of said nozzle needle means.

2. An injection valve according to claim 1, wherein said means for moving said nozzle needle means is operable to be initiated independently of injection pressure.

3. An injection valve according to claim 2, wherein said means for moving said nozzle needle means includes a lifting magnet means.

4. An injection valve according to claim 2, wherein said nozzle needle means is spring-loaded in a direction toward closing said nozzle aperture means.

5. An injection valve according to claim 4, wherein said abutment means further limits stroke movement of said nozzle needle means in said closing direction.

6. An injection valve according to claim 5, wherein said abutment means includes at least one shoulder means of said nozzle needle means engaging in a recess means of said valve body, said shoulder means having end faces forming abutment surfaces.

7. An injection valve according to claim 6, wherein said shoulder means are constructed as an annular collar.

8. An injection valve according to claim 6, wherein said recess means is provided in an end face of said valve body far-reaching said nozzle seat means, and wherein a cover means is secured to said valve body in facing relationship to said recess means, said cover means having an end face forming another abutment surface.

9. An injection valve according to claim 8, wherein said cover means is a disk having a radial slot.

10. An injection valve according to claim 8, wherein said cover means and said valve body are arranged at least partially in an external housing means and are secured together by the latter.

11. An injection valve according to claim 10, wherein said nozzle seat means includes a diaphragm means.

12. An injection valve according to claim 11, wherein said diaphragm means has different thicknesses over its radial extent.

13. An injection valve according to claim 11, wherein said diaphragm means is integral with said valve body.

14. An injection valve according to claim 11, wherein said diaphragm means is an independent member connected to said valve body.

15. An injection valve according to claim 14, wherein said diaphragm means is connected to said valve body by means of clamping.

16. An injection valve according to claim 10, wherein said nozzle seat means includes a displaceably guided portion being movable in the stroke direction of the nozzle needle means.

17. An injection valve according to claim 10, wherein said nozzle needle means is shielded substantially over its length against exterior heat by an annular return flow gap at least in an area adjacent to said nozzle seat means.

18. An injection valve according to claim 10, wherein at least one of said nozzle needle means adjacent said nozzle seat means and said nozzle seat means if freely exposed in at least part and is contacted by liquid supplied into the injection valve.

19. An injection valve according to claim 18, wherein both said nozzle needle means adjacent said nozzle seat means and said nozzle seat means are at least partly freely exposed and wetted by liquid supplied to the injection valve.

20. An injection valve according to claim 18, wherein a free space is arranged about said nozzle needle means adjacent said nozzle seat means and said free space is annular to form a swirl chamber.

21. An injection valve according to claim 20, wherein said swirl chamber is provided with at least one inflow aperture terminating approximately tangentially to said swirl chamber.

22. An injection valve according to claim 21, wherein said swirl chamber is provided with at least one return flow aperture, said return flow aperture adjoining said swirl chamber approximately tangentially.

23. An injection valve according to claim 22, wherein said inflow apertures and return flow apertures are mutually offset in an axial direction of said nozzle needle means.

24. An injection valve according to claim 23, wherein said at least one inflow aperture is provided adjacent to said nozzle seat means.

25. An injection valve according to claim 24, wherein said swirl chamber has an annular outer boundary defined by a bush-like insert member.

26. An injection valve according to claim 25, wherein said insert member is spring-loaded in a direction toward said nozzle seat means and is supported with respect to said nozzle seat means.

27. An injection valve according to claim 24, wherein said swirl chamber has an annular outer boundary defined by a nozzle needle guide means.

28. An injection valve according to claim 27, wherein said nozzle needle means includes a radially reinforced guide collar means disposed at a distance to a tip of said nozzle needle means, said guide collar means defining an upper boundary of said swirl chamber.

29. An injection valve according to claim 1, wherein said nozzle needle means is spring-loaded in a direction toward closing said nozzle aperture means.

30. An injection valve according to claim 1, wherein said abutment means further limits stroke movement of said nozzle needle means in said closing direction.

31. An injection valve according to claim 1, wherein said abutment means includes at least one shoulder means of said nozzle needle means engaging in a recess means of said valve body, said shoulder means having end faces forming abutment surfaces.

32. An injection valve according to claim 31, wherein said shoulder means is constructed by an annular collar.

33. An injection valve according to claim 31, wherein said recess means is provided in an end face of said valve body opposite said nozzle seat means, and wherein a cover means is secured to said valve body in facing relationship to said recess means, said cover means having an end face defining another abutment surface.

34. An injection valve according to claim 33, wherein said cover means is a disk having a radial slot.

35. An injection valve according to claim 33, wherein said cover means and said valve body are arranged at least partially in an external housing means and are secured together by the latter.

36. An injection valve according to claim 1, wherein said nozzle seat means includes a diaphragm means.

37. An injection valve according to claim 36, wherein said diaphragm means has different thicknesses over its radial extent.

38. An injection valve according to claim 1, wherein said nozzle seat means includes a displaceably guided portion being movable in the stroke direction of the nozzle needle means.

39. An injection valve according to claim 1, wherein said nozzle needle means is shielded substantially over its length against exterior heat by an annular return flow gap at least in an area adjacent to said nozzle seat means.

40. An injection valve according to claim 1, wherein at least one of said nozzle needle means adjacent said nozzle seat means and said nozzle seat means is freely exposed at least in part and is contacted by liquid supplied into the injection valve.

41. An injection valve according to claim 40, wherein both said nozzle needle means adjacent to said nozzle seat means and said nozzle seat means are at least partly freely exposed and wetted by liquid supplied to the injection valve.

42. An injection valve according to claim 40, wherein a free space is arranged about said nozzle needle means adjacent to said nozzle seat means and said free space is annular to form a swirl chamber.

43. An injection valve according to claim 42, wherein said swirl chamber is provided with at least one inflow aperture terminating approximately tangentially to said swirl chamber.

44. An injection valve according to claim 43, wherein said swirl chamber is provided with at least one return flow aperture, said return flow aperture adjoining said swirl chamber approximately tangentially.

45. An injection valve according to claim 44, wherein said inflow apertures and return flow apertures are mutually offset in an axial direction of said nozzle needle means.

46. An injection valve according to claim 43, wherein said at least one inflow aperture is provided adjacent to said nozzle seat means.

47. An injection valve according to claim 42, wherein said swirl chamber has an annular outer boundary defined by a bush-like insert member.

48. An injection valve according to claim 47, wherein said insert member is spring-loaded in a direction toward said nozzle seat means and is supported with respect to said nozzle seat means.

49. An injection valve according to claim 42, wherein said swirl chamber has an annular outer boundary defined by a nozzle needle guide means.

50. An injection valve according to claim 49, wherein said nozzle needle means includes a radially reinforced guide collar means disposed at aa distance to a tip of said nozzle needle means, guide collar means defining an upper boundary of said swirl chamber.

51. An injection valve according to claim 42, wherein said nozzle seat means includes a diaphragm means.

52. An injection valve according to claim 42, wherein said nozzle seat means includes a displaceably guided portion being movable in the stroke direction of the nozzle needle means.

53. An injection valve according to claim 1, wherein said needle aperture means opens into a combustion space of an internal combustion engine, such that fuel is injected into said combustion space.

* * * * *